US007222921B2

(12) United States Patent
Farnella et al.

(10) Patent No.: US 7,222,921 B2
(45) Date of Patent: May 29, 2007

(54) WHEELCHAIR WITH FOOT REST

(75) Inventors: William G. Farnella, Green Brook, NJ (US); Ronald G. Litke, Jr., Danbury, CT (US); James A. Fleming, III, Bethlehem, PA (US)

(73) Assignee: Ethicon, Inc., Somerville, NJ (US)

( * ) Notice: Subject to any disclaimer, the term of this patent is extended or adjusted under 35 U.S.C. 154(b) by 0 days.

(21) Appl. No.: 11/178,996

(22) Filed: Jul. 11, 2005

(65) Prior Publication Data

US 2006/0012146 A1 Jan. 19, 2006

(51) Int. Cl.
*A47C 7/50* (2006.01)

(52) U.S. Cl. ..... 297/423.26; 297/DIG. 4; 280/250.1; 280/304.1

(58) Field of Classification Search ..... 297/DIG. 4, 297/316, 340, 330, 400, DIG. 10, 83, 423.25, 297/423.26; 280/250.1, 304.1, 210
See application file for complete search history.

(56) References Cited

U.S. PATENT DOCUMENTS

| | | | | |
|---|---|---|---|---|
| 4,634,183 | A | 1/1987 | Ruiz | |
| 5,772,234 | A | 6/1998 | Luo | |
| 5,904,398 | A | 5/1999 | Farricielli | |
| 6,186,252 | B1 | 2/2001 | Schaffner et al. | |
| 6,352,307 | B1 * | 3/2002 | Engman | 297/284.11 |
| 6,412,801 | B1 * | 7/2002 | Izuchukwu et al. | 280/250.1 |
| 6,422,653 | B1 * | 7/2002 | Szczepanski et al. | 297/423.29 |
| 6,425,634 | B1 * | 7/2002 | Romero | 297/331 |
| 6,428,103 | B1 * | 8/2002 | Hong | 297/354.13 |
| 6,459,962 | B2 | 10/2002 | Ulrich et al. | |
| 2001/0011805 | A1 | 8/2001 | Kueschall | |

* cited by examiner

*Primary Examiner*—Anthony D Barfield

(57) ABSTRACT

A wheelchair has a frame which includes a right fore member and a left fore member, and a footrest between them. The footrest includes a right supporting arm extending rearwardly from the right fore member, a left supporting arm extending rearwardly from the left fore member, and a panel upon which may rest a users feet and which pivotably attaches to the right supporting arm at a rearward portion thereof and pivotably attaches to the left supporting arm at a rearward portion thereof. The panel is pivotable upwardly and rearwardly from a first position in which it is generally horizontally oriented for supporting the user's feet to a second position behind the user's feet whereby to allow the user to stand unencumbered by the panel.

7 Claims, 5 Drawing Sheets

WHEELCHAIR WITH FOOT REST

BACKGROUND

Footrests that retract out of position when not in use are commonly found on collapsible or "folding" wheelchairs. The benefits of these retractable footrests are two fold. First, once it is retracts, this type of footrest facilitates the folding of the wheelchair into a smaller overall size. Secondly, the footrest can be retracted away from its normal position, supporting the weight of the users feet, so that the user may put their feet directly on the floor beneath the footrest. This aids the users in transferring into and out of the wheelchair. Some wheelchairs that have a rigid frame which does not collapse into a smaller size can also benefit from the addition of a swing away footrest. Since these rigid frames do not collapse, that particular benefit of the retractable footrest is not utilized, but the improvement in transferring into and out of the wheelchair are every but as necessary in a rigid frame wheelchair as they are in a collapsible wheelchair. Some types of rigid wheelchair designs rely upon the footrest as a structural member of the overall wheelchair frame and therefore the integrity of the frame would be compromised by a retractable footrest design similar to those found on collapsible wheelchairs. Some retractable footrest designs may attempt to provide some structural rigidity by interlocking in some way when they are functioning as a footrest, but this rigidity is lost when they are retracted for a user transferring in or out of the chair, a point at which it is arguable that the rigidity of the chair is most critical. This design addresses that particular issue by providing a retractable footrest that maintains a structurally rigid cross member regardless of the orientation of the footrest itself.

SUMMARY OF THE INVENTION

A wheelchair according to the present invention has a frame which comprises a right fore member and a left fore member, and a footrest between them. The footrest comprises a right supporting arm extending rearwardly from the right fore member, a left supporting arm extending rearwardly from the left fore member, and a panel upon which may rest a users feet and which pivotably attaches to the right supporting arm at a rearward portion thereof and pivotably attaches to the left supporting arm at a rearward portion thereof. The panel is pivotable upwardly and rearwardly from a first position in which it is generally horizontally oriented for supporting the user's feet to a second position behind the user's feet whereby to allow the user to stand unencumbered by the panel.

Preferably, a biasing member between the panel and at least one of the left supporting arm and the right supporting arm biases the panel upwards to an intermediate orientation between the generally horizontal orientation and the generally vertical orientation whereby to allow the user to more easily reach the panel to move it into the generally vertical orientation. Preferably this comprises a first biasing member between the panel and the left supporting arm and a second biasing member between the panel and the right supporting arm. In one aspect of the invention, the first biasing member and second biasing members comprise springs.

In one aspect of the invention, the right supporting arm attaches to the right fore member via a right mounting tube telescopically connected to the right fore member and attached to the right supporting arm and wherein the left supporting arm attaches to the left fore member via a left mounting tube telescopically connected to the left fore member and attached to the left supporting arm.

Preferably, a pivotable and lockable attachment between the right supporting arm and the right mounting tube and also between the left supporting arm and the left mounting tube allows adjustment of the orientation of the panel with respect to horizontal.

Preferably, the panel rests upon the left supporting arm and upon the right supporting arm in the first position.

Preferably, the panel provides structural support between the left fore member and the right fore member in both its first position and its second position.

DETAILED DESCRIPTION OF THE INVENTION

Figure 1:
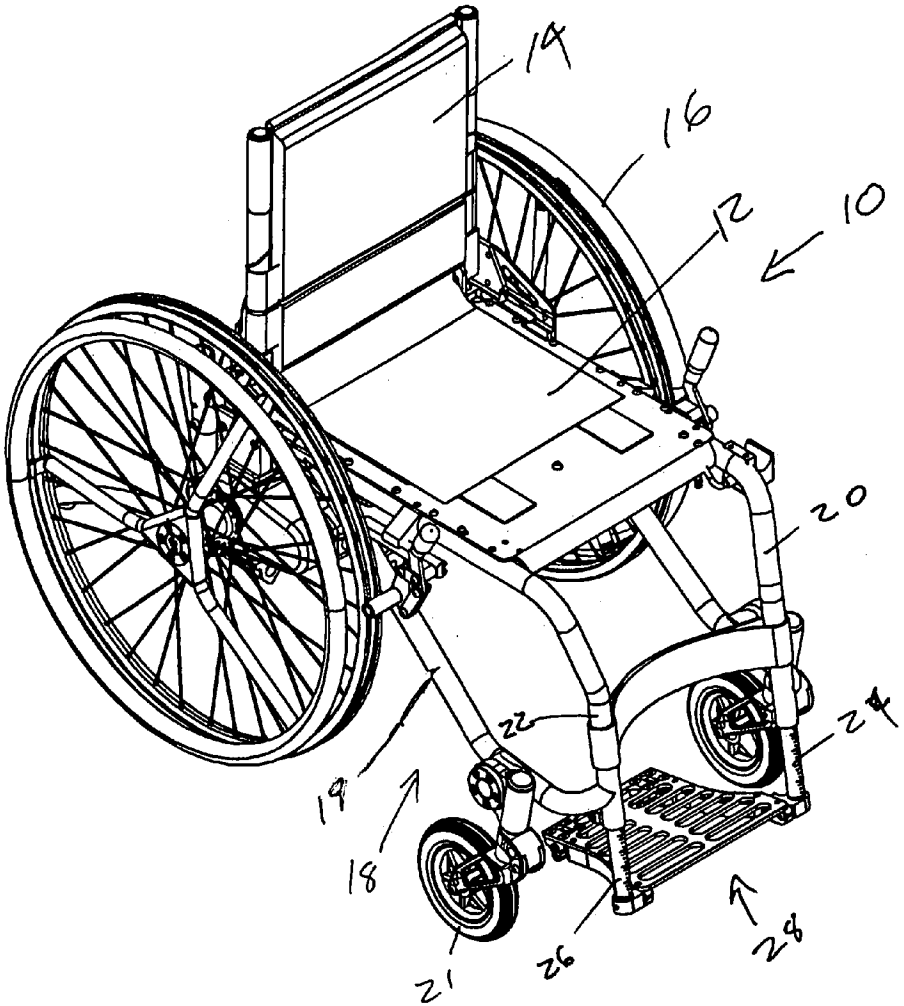
FIG. 1 is a perspective view of a wheelchair according to the present invention.

FIG. 1 illustrates in gross a wheelchair 10 which comprises a seat 12, a backrest 14 and a pair of driving wheels 16. A frame 18 rigidly ties together the seat 12, backrest 14 and driving wheels 16. The frame 18 carries a left fore member 20 and right fore member 22 which are open and tubular and which receive a left mounting tube 24 and right mounting tube 26 to mount a retractable footrest 28 to the chair 10. Additional frame elements 19 extend down from the seat 12 to join the fore members 20 and 22. These frame elements 19 provide added rigidity and support, and also carry front supporting wheels 21.

The unique footrest 28 is particularly suitable for employment in self propelled wheelchairs such as described in the Ulrich et al. U.S. Pat. No. 6,459,962, incorporated herein by reference. It adds rigidity adjacent the front wheels 21 and thus has utility for other wheelchair designs, especially those comprising a rigid, non-collapsing frame, such as the frame 18.

Figure 2:
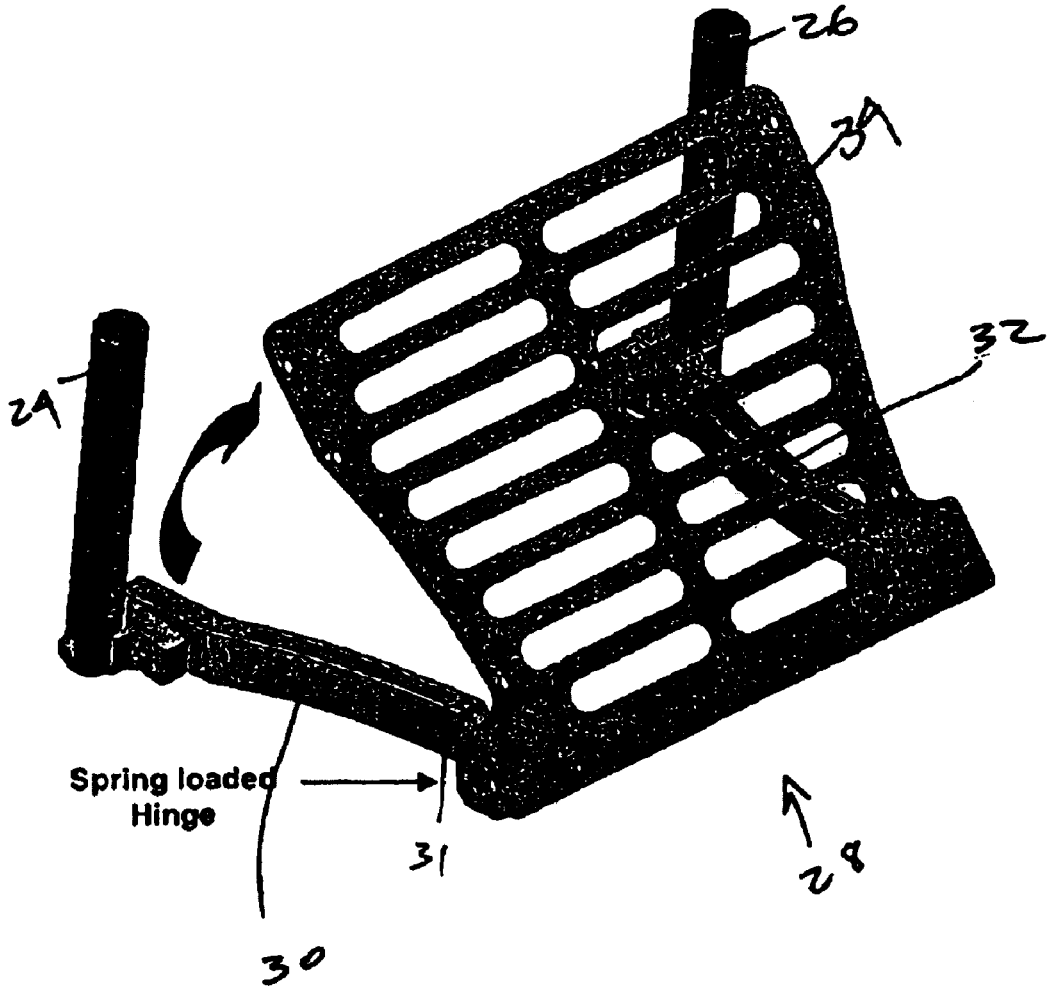
FIG. 2 a rear, perspective view of a footrest according to the invention for the wheelchair of FIG. 1.
Figure 3:
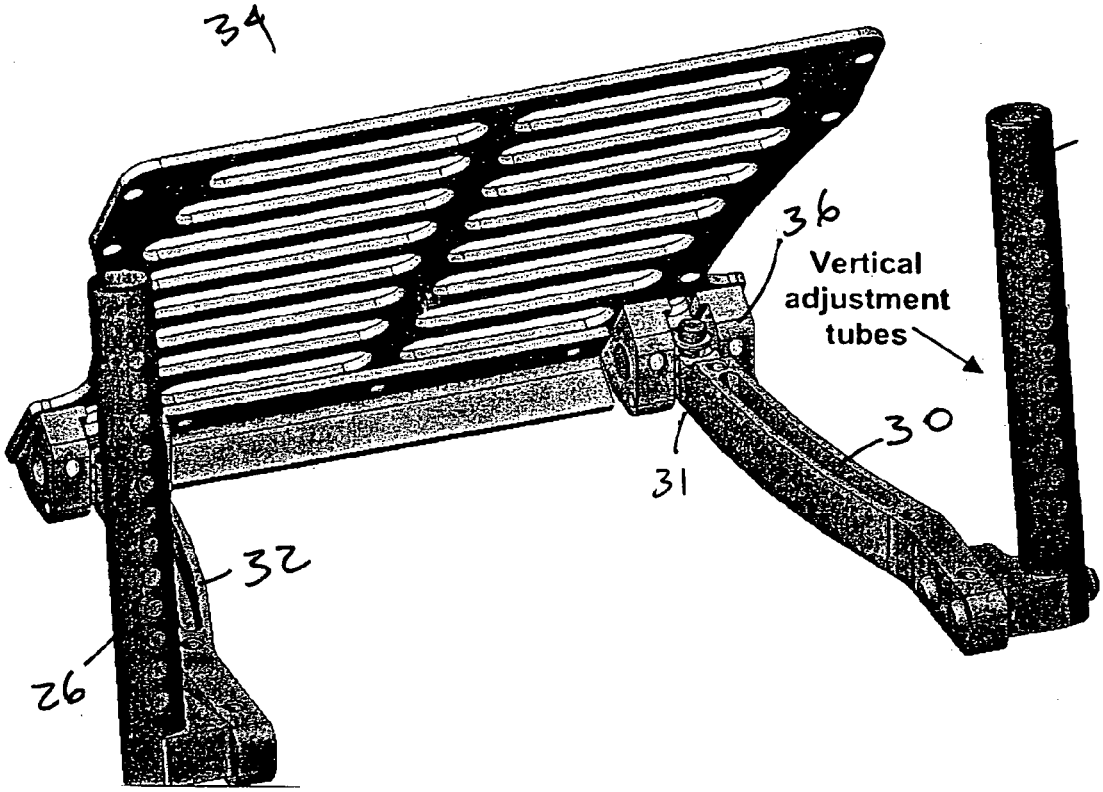
FIG. 3 is a front, perspective view of the footrest of FIG. 2.

Turning also now to FIGS. 2 and 3, the footrest 28 comprises a generally horizontal left supporting arm 30 and generally horizontal right supporting arm 32. These connect to the respective mounting tubes 24 and 26. A footrest plate or panel 34 attaches by means of hinges 36 to the supporting arms 30 and 32 at their rearward ends 31. Springs 38 (see also FIG. 5) in the hinges 36 bias the panel 34 slightly upwardly so that a user may either grasp it and move it up and back with a hand or kick it back with a foot after removing their feet from the panel 34. When their feet are resting upon the panel 34 the weight of their feet holds the panel 34 down and resting upon the supporting arms 30 and 32.

The panel 34 itself provides lateral rigidity to the wheelchair 10 and because the supporting arms 30 and 32 extend rearwardly from the fore members 20 and 22, and because the hinges 36 are located at the rearward portion 31 of the supporting arms 30 and 32, the panel 34 can swing upwardly and rearwardly to a position (illustrated in FIG. 4) out of the way of where a user's feet need to be positioned to stand up comfortably from the wheelchair 10.

Figure 5:
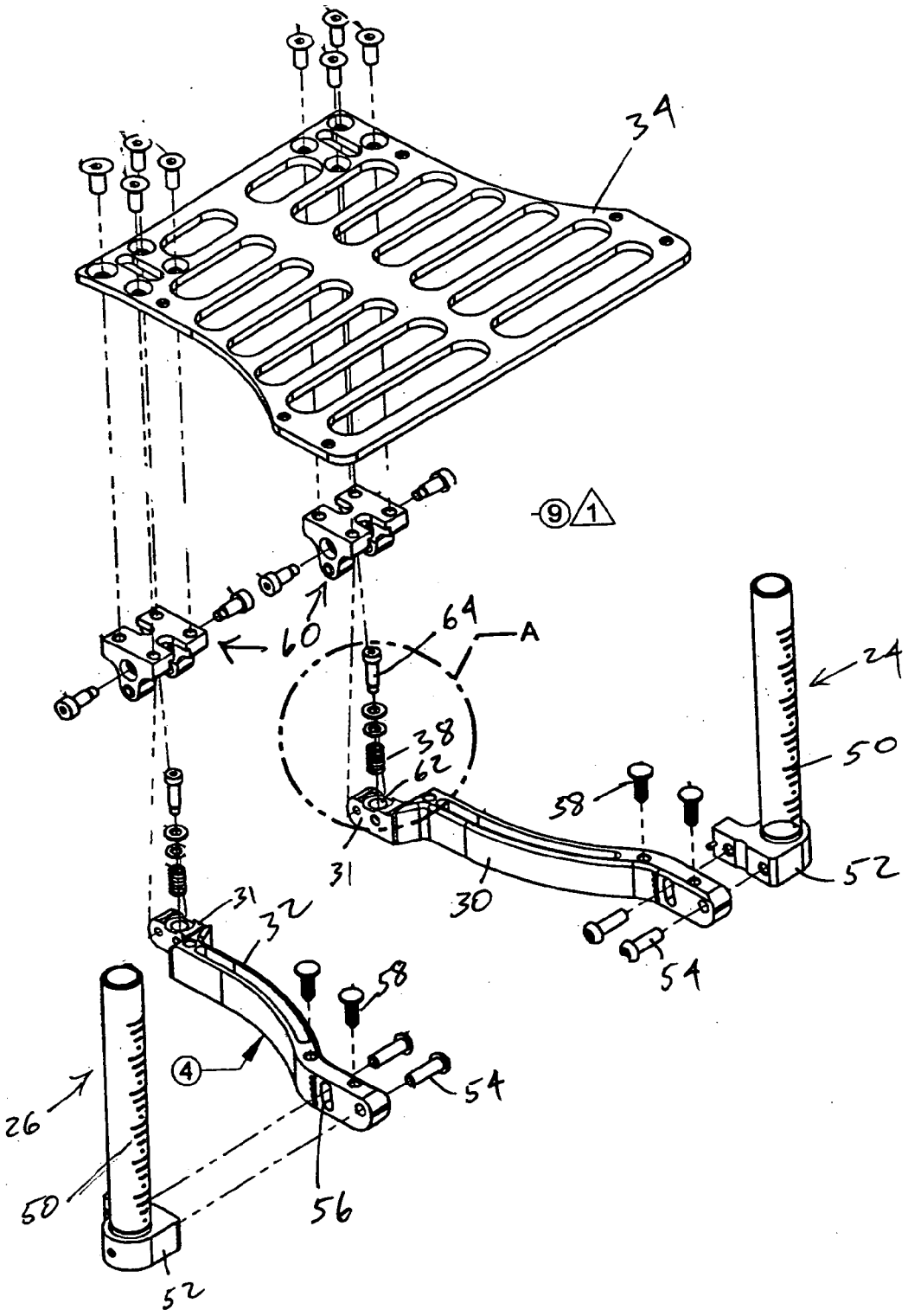
FIG. 5 is an exploded perspective view of the footrest of FIG. 2.

As most easily seen in FIG. 5, yet with reference to the preceding figures, the mounting tubes 24 and 26 have a scale 50 thereon for assisting their positioning within the fore members 20 and 22. They may be clamped therein with a compression clamp, with a bolt passing through the fore member 20 and mounting tube 24 or other suitable connection. The mounting tubes carry supporting arm brackets 52 at their lowest extent. The supporting arms 30 and 32 attach to the supporting arm brackets 52 via bolts 54. A rear bolt hole 56 in each supporting arm 30 and 32 allows a degree of up and down pivotal adjustment of the supporting arms 30 and 32 with respect to the mounting tubes 24 and 26. Rubber or other cushioning inserts 58 inserted into an upper surface of the supporting arms 30 and 32 adjacent the supporting arms 30 and 32 provide a surface upon which the footrest plate 34 can rest.

Figure 4:
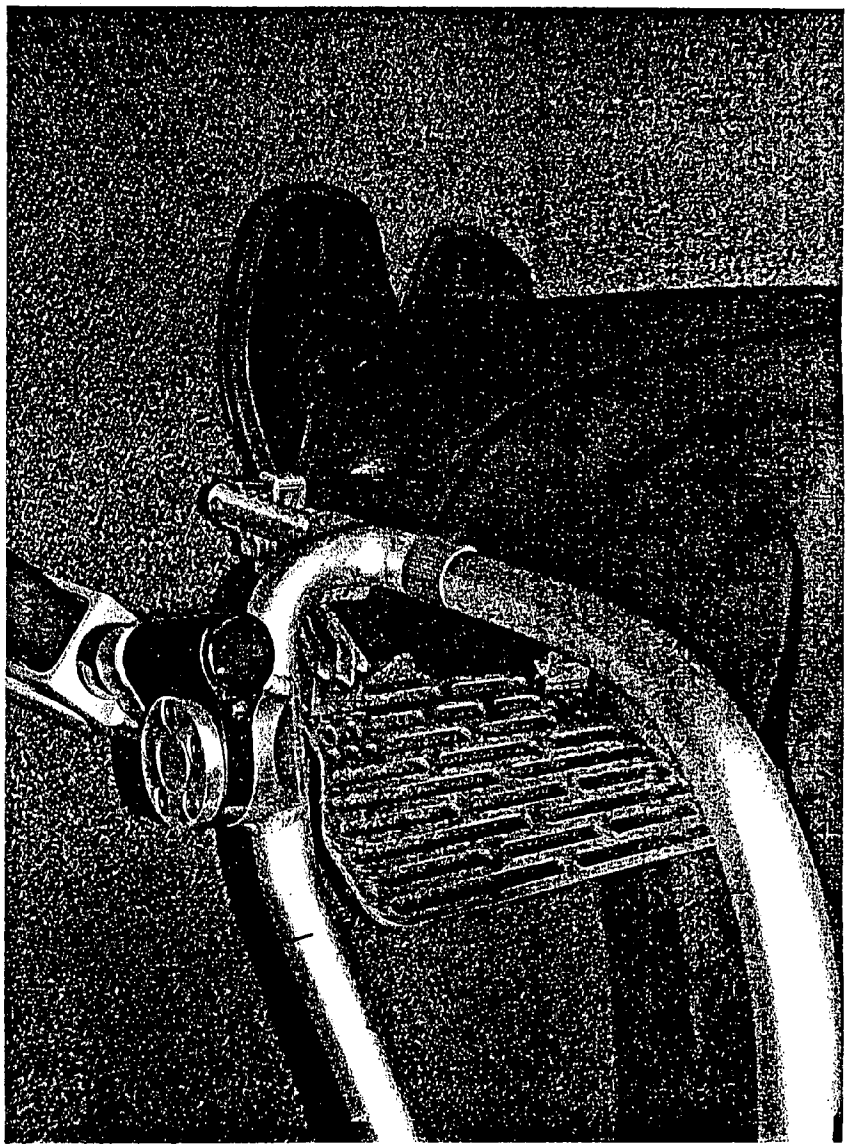
FIG. 4 is a side perspective view of the footrest of FIG. 2 shown in its raised position.

Mounting brackets 60 mount to the footrest plate 34 on its bottom surface at the rear. The mounting brackets 60 pivotably attach to the rear ends 31 of the supporting arms 30 and 32 and thereby allow the footrest plate 34 to pivot from a first position as seen in FIG. 1 where it is resting upon the supporting arms 30 and 32 in a generally horizontal orientation (although the tilt with respect to horizontal can be adjusted for user comfort) for supporting a user's feet, into a second position as seen in FIG. 4 where the footrest plate 34 is pivoted upwardly and rearwardly behind a user's feet to allow the user to place their feet onto the ground and rise up out of the wheelchair 10 more easily.

Springs 38 within holes 62 bear against bolts 64 which bias the footrest plate 34 to rotate upwardly slightly toward the upright position. In one aspect of the invention the resting position of the footrest plate 34 (without the weight of a user's legs thereon) is approximately intermediate the downward and upwards positions, as illustrated in FIGS. 2 and 3. From this position a user can use his or her legs to kick the footrest plate 34 into the upright position or simply reach down with one hand to pull the footrest plate 34 into the upright position.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A wheelchair having a frame, the frame comprising a right fore member and a left fore member, and a footrest therebetween, the footrest comprising:

a right supporting arm extending rearwardly from the right fore member;

a left supporting arm extending rearwardly from the left fore member;

a panel upon which may rest a users feet and which pivotably attaches to the right supporting arm at a rearward portion thereof and pivotably attaches to the left supporting arm at a rearward portion thereof;

wherein the panel is pivotable upwardly and rearwardly from a first position in which it is generally horizontally oriented for supporting the user's feet to a second position behind the user's feet whereby to allow the user to stand unencumbered by the panel; and a biasing member between the panel and at least one of the left supporting arm and the right supporting arm, the biasing member biasing the panel upwards to an intermediate orientation between the generally horizontal orientation and the generally vertical orientation whereby to allow the user to more easily reach the panel to move it into the generally vertical orientation.

2. A wheelchair according to claim 1 comprising a first biasing member between the panel and the left supporting arm and a second biasing member between the panel and the right supporting arm.

3. A wheelchair according to claim 2 wherein the first biasing member and second biasing members comprise springs.

4. A wheelchair according to claim 1 wherein the right supporting arm attaches to the right fore member via a right mounting tube telescopically connected to the right fore member and attached to the right supporting arm and wherein the left supporting arm attaches to the left fore member via a left mounting tube telescopically connected to the left fore member and attached to the left supporting arm.

5. A wheelchair according to claim 1 wherein the panel rests upon the left supporting arm and upon the right supporting arm in the first position.

6. A wheelchair according to claim 1 wherein the panel provides structural support between the left fore member and the right fore member in both its first position and its second position.

7. A wheelchair having a frame, the frame comprising a right fore member and a left fore member, and a footrest therebetween, the footrest comprising:

a right supporting arm extending rearwardly from the right fore member;

a left supporting arm extending rearwardly from the left fore member;

a panel upon which may rest a users feet and which pivotably attaches to the right supporting arm at a rearward portion thereof and pivotably attaches to the left supporting arm at a rearward portion thereof;

wherein the panel is pivotable upwardly and rearwardly from a first position in which it is generally horizontally oriented for supporting the user's feet to a second position behind the user's feet whereby to allow the user to stand unencumbered by the panel;

wherein the right supporting arm attaches to the right fore member via a right mounting tube telescopically connected to the right fore member and attached to the right supporting arm and wherein the left supporting arm attaches to the left fore member via a left mounting tube telescopically connected to the left fore member and attached to the left supporting arm; and a pivotable and lockable attachment between the right supporting arm and the right mounting tube and also between the left supporting arm and the left mounting tube whereby to allow adjustment of the orientation of the panel with respect to horizontal.

* * * * *